US008646276B2

(12) United States Patent
Davis, Jr. et al.

(10) Patent No.: US 8,646,276 B2
(45) Date of Patent: Feb. 11, 2014

(54) COMBUSTOR ASSEMBLY FOR A TURBINE ENGINE WITH ENHANCED COOLING

(75) Inventors: Lewis Berkley Davis, Jr., Niskayuna, NY (US); Ronald James Chila, Greer, SC (US)

(73) Assignee: General Electric Company, Schenectady, NY (US)

( * ) Notice: Subject to any disclaimer, the term of this patent is extended or adjusted under 35 U.S.C. 154(b) by 502 days.

(21) Appl. No.: 12/616,304

(22) Filed: Nov. 11, 2009

(65) Prior Publication Data

US 2011/0107766 A1 May 12, 2011

(51) Int. Cl.
*F02C 1/00* (2006.01)

(52) U.S. Cl.
USPC ..... 60/756; 60/752; 60/754; 60/758

(58) Field of Classification Search
USPC ..... 60/752, 754, 758, 760, 753, 755, 756, 60/757, 759
See application file for complete search history.

(56) References Cited

U.S. PATENT DOCUMENTS

| | | | | |
|---|---|---|---|---|
| 4,719,748 | A | 1/1988 | Davis, Jr. et al. | |
| 4,872,312 | A * | 10/1989 | Iizuka et al. | 60/760 |
| 4,875,339 | A | 10/1989 | Rasmussen et al. | |
| 5,581,994 | A * | 12/1996 | Reiss et al. | 60/782 |
| 5,687,572 | A * | 11/1997 | Schrantz et al. | 60/753 |
| 5,758,504 | A * | 6/1998 | Abreu et al. | 60/754 |
| 5,960,632 | A * | 10/1999 | Abuaf et al. | 60/752 |
| 6,484,505 | B1 * | 11/2002 | Brown et al. | 60/760 |
| 6,615,588 | B2 * | 9/2003 | Hoecker | 60/752 |
| 6,681,578 | B1 | 1/2004 | Bunker | |
| 7,010,921 | B2 | 3/2006 | Intile et al. | |
| 7,036,316 | B2 * | 5/2006 | Howell et al. | 60/772 |
| 7,082,770 | B2 * | 8/2006 | Martling et al. | 60/796 |
| 7,270,175 | B2 * | 9/2007 | Mayer et al. | 165/47 |
| 7,389,643 | B2 * | 6/2008 | Simons et al. | 60/772 |
| 7,574,865 | B2 * | 8/2009 | Bland | 60/752 |
| 7,870,738 | B2 * | 1/2011 | Zborovsky et al. | 60/752 |
| 7,900,459 | B2 * | 3/2011 | Farah | 60/770 |
| 8,166,764 | B2 * | 5/2012 | Chokshi et al. | 60/772 |
| 8,291,711 | B2 * | 10/2012 | Chokshi et al. | 60/772 |
| 2002/0189260 | A1 * | 12/2002 | David et al. | 60/746 |
| 2005/0144954 | A1 * | 7/2005 | Lemon et al. | 60/752 |
| 2006/0010879 | A1 * | 1/2006 | Aumont et al. | 60/796 |
| 2006/0032237 | A1 * | 2/2006 | Aumont et al. | 60/796 |
| 2006/0101801 | A1 | 5/2006 | Bland | |
| 2006/0179770 | A1 * | 8/2006 | Hodder | 52/588.1 |
| 2006/0283189 | A1 * | 12/2006 | Lipinski et al. | 60/772 |
| 2007/0062198 | A1 * | 3/2007 | Huth et al. | 60/752 |
| 2007/0209366 | A1 * | 9/2007 | Gerendas et al. | 60/752 |
| 2007/0245741 | A1 | 10/2007 | Johnson et al. | |
| 2010/0031665 | A1 * | 2/2010 | Chokshi et al. | 60/760 |
| 2012/0198854 | A1 * | 8/2012 | Schilp et al. | 60/755 |

* cited by examiner

*Primary Examiner* — Gerald L Sung
*Assistant Examiner* — Michael B Mantyla
(74) *Attorney, Agent, or Firm* — Nixon & Vanderhye P.C.

(57) ABSTRACT

A combustor assembly for a turbine engine includes a combustor liner and a flow sleeve which surrounds the combustor liner. Compressed air flows through an annular space located between an outer surface of the combustor liner and an inner surface of the flow sleeve. A plurality of cooling holes are formed through the flow sleeve to allow compressed air to flow from a position outside the flow sleeve, through the cooling holes, and into the annular space. The height of the annular space may vary along the length of the combustor assembly. Thus, the flow sleeve may have reduced diameter portions which result in the height of the annular space being smaller in certain locations than at other locations along the length of the combustor assembly.

14 Claims, 10 Drawing Sheets

COMBUSTOR ASSEMBLY FOR A TURBINE ENGINE WITH ENHANCED COOLING

BACKGROUND OF THE INVENTION

Turbine engines used in the electrical power generation industry typically include a compressor section which is surrounded by a plurality of combustors. In each combustor, compressed air from the compressor section of the turbine is introduced into an interior of a combustor liner. The compressed air is mixed with fuel, and the fuel-air mixture is then ignited. The combustion gases then pass out of the combustor and into the turbine section of the engine.

In a typical combustor assembly, the combustor liner is surrounded by a flow sleeve. An annular space located between an inner surface of the flow sleeve and an outer surface of the combustor liner conducts a flow of compressed air from the compressor section of the turbine into the interior of the combustor liner where combustion takes place. Compressed air from the compressor section of the turbine also surrounds an exterior of the flow sleeve. Cooling holes may be formed in the flow sleeve to allow compressed air to pass from a position outside the flow sleeve, through the cooling holes, and into the annular space. The flow of compressed air through the cooling holes impinges on the exterior surface of the combustor liner. This flow of compressed air through the cooling holes against the outer surface of the combustor liner helps to cool the combustor liner.

BRIEF DESCRIPTION OF THE INVENTION

In a first aspect, the invention may be embodied in a combustor for a turbine engine that includes a combustor liner, an end cap mounted at an upstream end of the combustor liner, and a flow sleeve that surrounds an exterior of the combustor liner. Compressed air flows through an annular space between an outer surface of the combustor liner and an inner surface of the flow sleeve. Cooling holes penetrate the flow sleeve, the cooling holes allowing compressed air to flow from an exterior of the flow sleeve into the annular space. The flow sleeve includes at least one reduced diameter portion, a height of the annular space being smaller along the at least one reduced diameter portion of the flow sleeve than along other portions of the flow sleeve.

In a second aspect, the invention may be embodied in a combustor for a turbine engine that includes a combustor liner, an end cap mounted at an upstream end of the combustor liner, and a flow sleeve that surrounds an exterior of the combustor liner. Compressed air flows through an annular space between an outer surface of the combustor liner and an inner surface of the flow sleeve. Cooling holes penetrate the flow sleeve, the cooling holes allowing compressed air to flow from an exterior of the flow sleeve into the annular space. A height of the annular space between the inner surface of the flow sleeve and the outer surface of the combustor liner varies along a length of the flow sleeve.

DETAILED DESCRIPTION OF PREFERRED EMBODIMENTS

Figure 1:
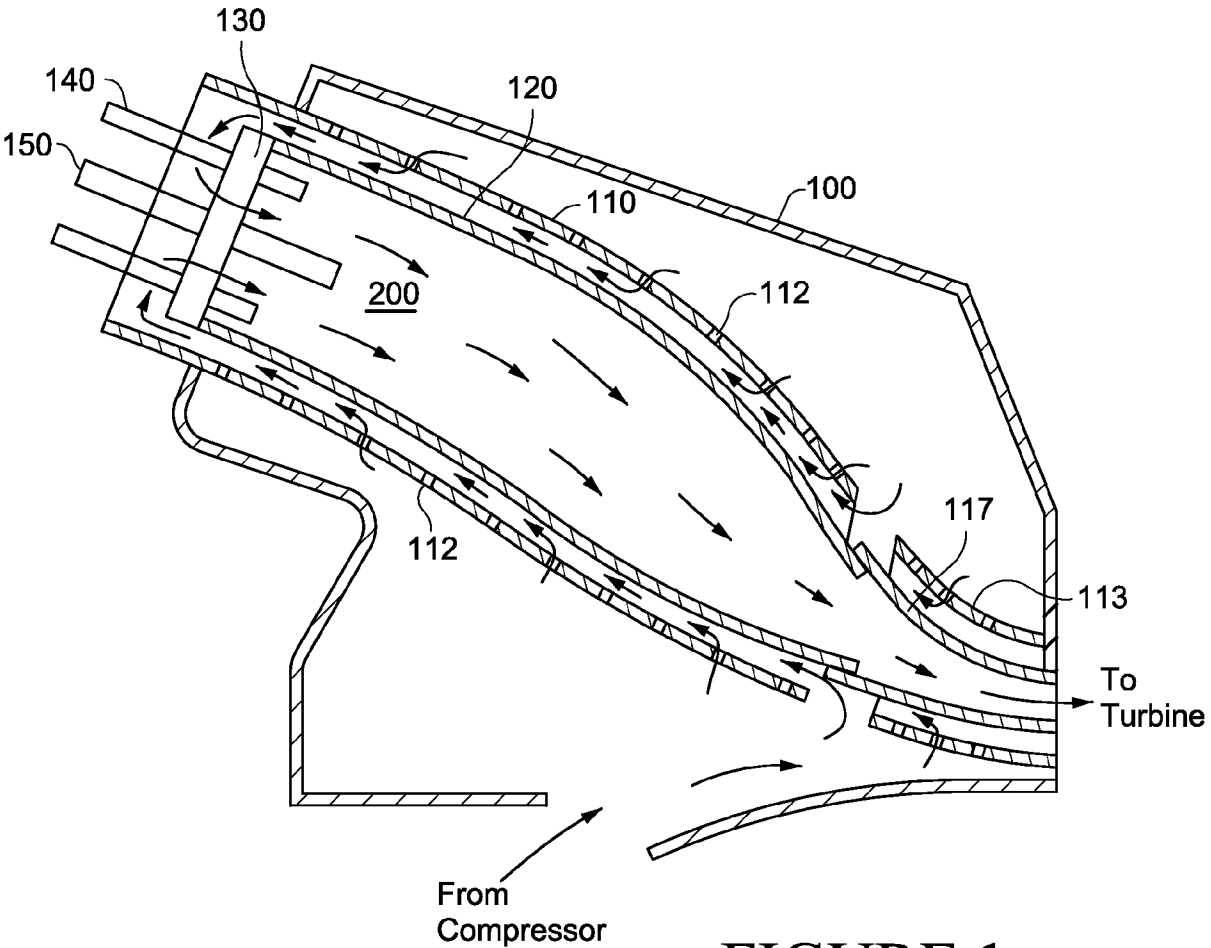
FIG. 1 is a cross sectional view illustrating a typical combustor assembly for a turbine engine.

A typical combustor assembly for a turbine engine is illustrated in FIG. 1. As shown therein, a casing 100 surrounds the exterior of the combustor assembly. Compressed air from the compressor section of a turbine enters inside the casing from below.

The combustor assembly includes a flow sleeve 110 which surrounds a generally cylindrical combustor liner 120. The downstream end of the combustor liner 120 delivers the combustion products into a transition piece 117. The transition piece 117 conducts the flow of combustion products into the turbine section of the engine. An impingement sleeve 113 surrounds the exterior of the transition piece 117.

An end cap 130 is located at the upstream end of the combustor liner 120. A plurality of primary fuel nozzles 140 are mounted around the exterior of the cylindrical end cap 130. In addition, a secondary fuel nozzle 150 is located at the center of the end cap 130. A combustion zone 200 is located just downstream of the primary and secondary fuel nozzles.

Compressed air from the compressor section of the turbine enters an annular space formed between an outer surface of the combustor liner 120 and an inner surface of the flow sleeve 110. The arrows in FIG. 1 illustrate that the compressed air in this annular space moves down the length of the combustor assembly towards the end cap 130 and the fuel nozzles. The compressed air then turns 180° behind the end cap 130 and flows into the combustion zone 200. The compressed air flowing past the fuel nozzles is mixed with fuel delivered into the compressed air stream through the fuel nozzles. The fuel-air mixture is then ignited just downstream of the fuel nozzles in the combustion zone 200. The combustion gases then pass down the length of the combustor liner, as indicated by the arrows, and the combustion gases pass through the transition piece 117 at the downstream end of the combustor liner 120 and into the turbine section of the engine.

A plurality of cooling holes 112 can be located along the length of the flow sleeve 110. Cooling holes may also be located on the impingement sleeve 113 which surrounds the transition piece 117. As shown by the arrows in FIG. 1, compressed air can pass from a location outside the flow sleeve, through the cooling holes 112 and into the annular space between the combustor liner 120 and the flow sleeve 110. The movement of the compressed air through the cooling holes 112 causes that compressed air to impinge on the outer surface of the combustor liner 120, and this compressed air helps to cool the combustor liner 120. Likewise, cooling air may pass through the cooling holes in the impingement sleeve 113 surrounding the transition piece 117 and impinge on the exterior surface of the transition piece 117 to cool the transition piece 117.

Figure 2:
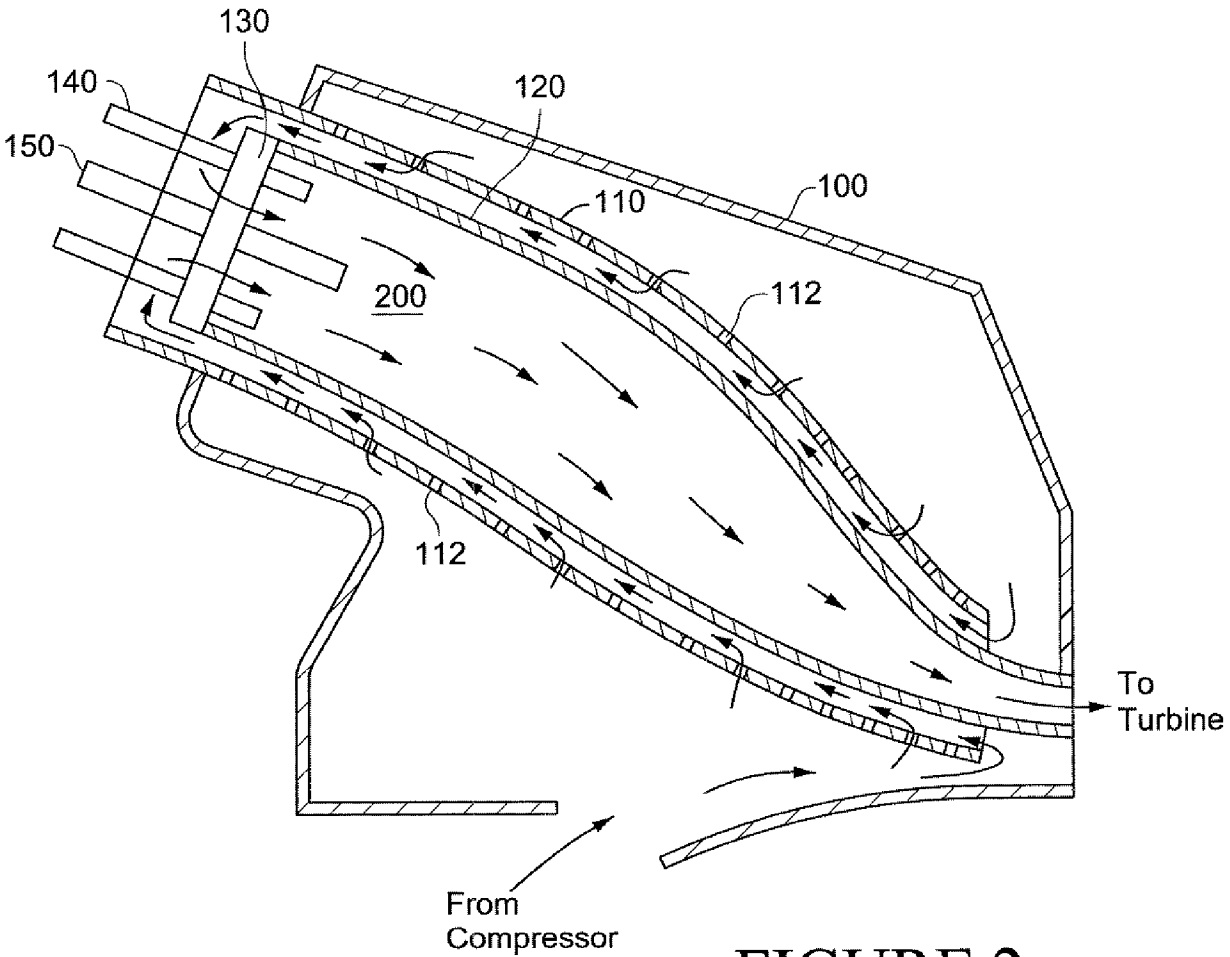
FIG. 2 is a cross sectional view illustrating another typical combustor assembly for a turbine engine.

FIG. 2 shows an alternate design of a combustor, where the transition piece 117 and impingement sleeve 113 have been eliminated. In this embodiment, the combustor liner 120 extends all the way down to the entrance to the turbine section of the engine.

In either of the embodiments illustrated in FIGS. 1 and 2, a great number of cooling holes per unit area may be located in those portions of the flow sleeve which surround the hotter portions of the combustor liner. Thus, providing a greater number of cooling holes per unit area will help to cool the hotter portions of the combustor liner 120.

Figure 3:
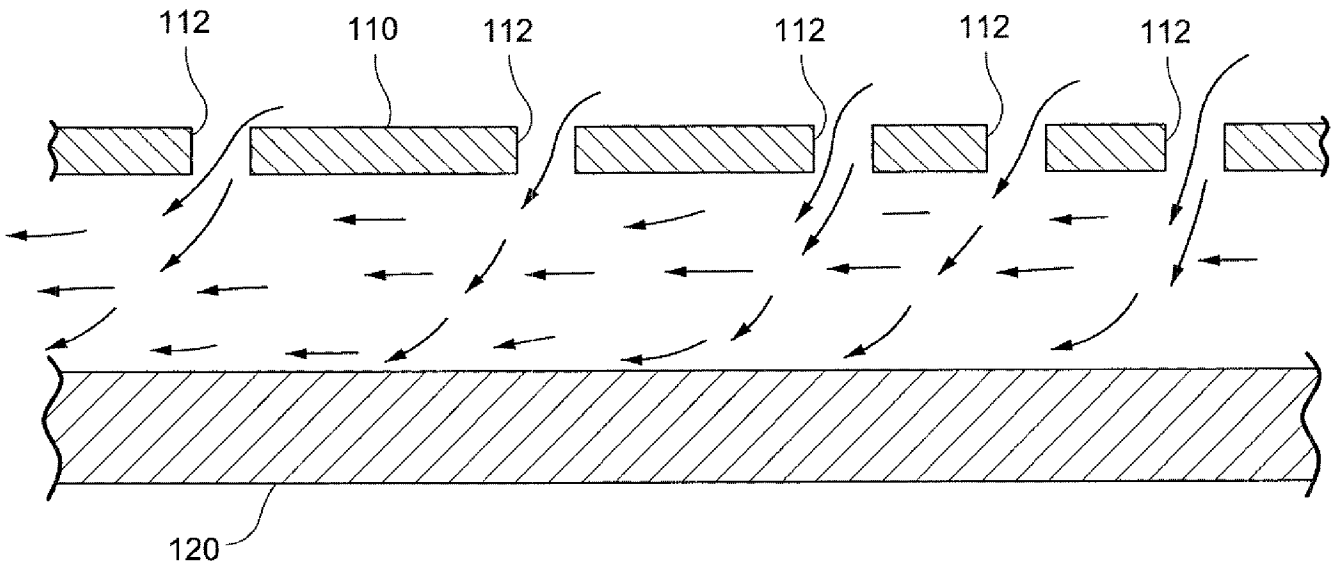
FIG. 3 is a cross sectional view showing a portion of a combustor assembly which includes the combustor liner and the surrounding flow sleeve.

FIG. 3 provides a close-up cross sectional view of a portion of the combustor assembly. As shown in FIG. 3, a plurality of cooling holes 112 are formed in a flow sleeve 110 which surrounds a combustor liner 120. The arrows in FIG. 3 illustrate the flow of compressed air both in the annular space between the combustor liner 120 and the flow sleeve 110 and through the cooling holes 112. As shown in FIG. 3, the air entering the annular space through the cooling holes 112 tends to travel down through the annular space to impinge on the outer surface of the combustor liner 120, to thereby help to cool the combustor liner 120.

Figure 4:
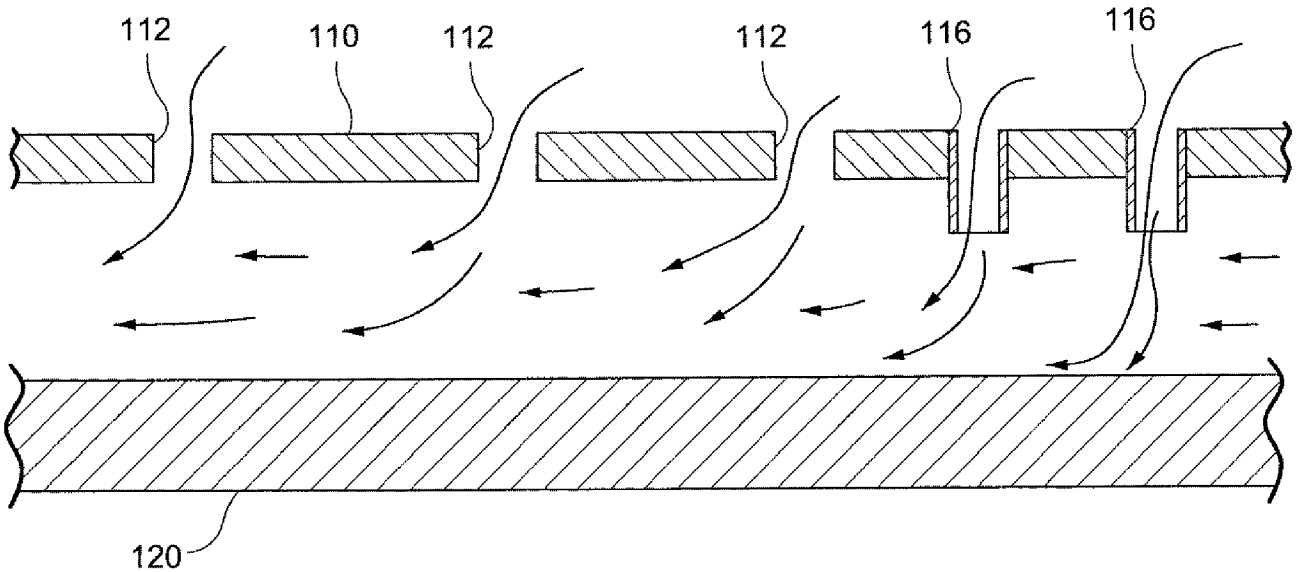
FIG. 4 is a cross sectional view showing of a portion of a combustor assembly which includes the combustor liner and the surrounding flow sleeve.

FIG. 4 shows a view similar to FIG. 3. In FIG. 4, the flow sleeve 110 includes a plurality of cooling thimbles 116 mounted in certain ones of the cooling holes 112. The cooling thimbles 116 have a cylindrical portion which extends from the inner surface of the flow sleeve 110 down towards the outer surface of the combustor liner 120. As a result, the cooling thimbles 116 help to ensure that the cooling air entering through the cooling holes of the flow sleeve is directed more forcefully against the outer surface of the combustor liner 120. The use of cooling thimbles 116 helps to enhance the cooling effect provided by the cooling holes 112 and experienced by the combustor liner 120. However, the presence of the cooling thimbles 116 extending down into the annular space can impede the smooth flow of compressed air along the annular space between the combustor liner and the flow sleeve.

Figure 5:
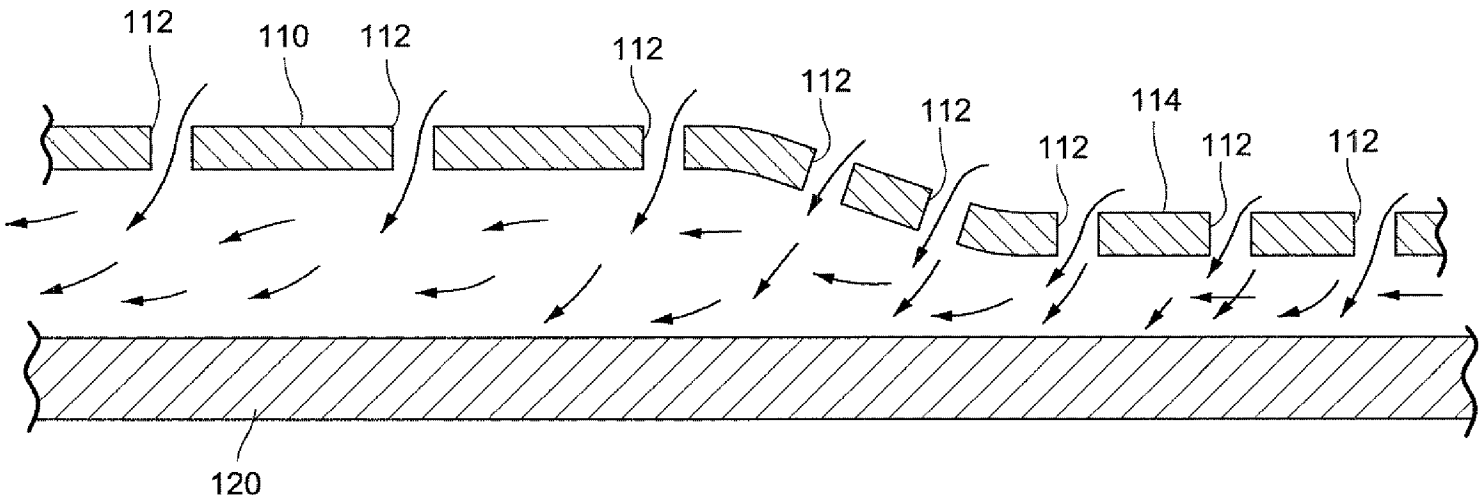
FIG. 5 is a cross sectional view showing of a portion of a combustor assembly which includes the combustor liner and the surrounding flow sleeve, where a portion of the flow sleeve has a reduced diameter.

FIG. 5 shows a view similar to FIGS. 3 and 4. As shown in FIG. 5, the flow sleeve 110 surrounds the exterior of the combustor liner 120. However, in the embodiment illustrated in FIG. 5, the flow sleeve 110 has a reduced diameter portion 114. As a result, a height of the annular space between the outer surface of the combustor liner 120 and the inner surface of the flow sleeve 110 is reduced along the reduced diameter portion 114 of the flow sleeve 110.

The cooling air passing through the cooling holes 112 in the reduced diameter portion 114 of the flow sleeve 110 is more effectively forced upon the outer surface of the combustor liner 120. Thus, forming the flow sleeve so that it includes a reduced diameter portion 114 can help to enhance the cooling effect experienced by the combustor liner along the reduced diameter portion of the flow sleeve 110. In this sense, the reduced diameter portion 114 of the flow sleeve 110 operated in a fashion similar to the cooling thimbles illustrated in FIG. 4. However, in the embodiment illustrated in FIG. 5, thimbles are not required in order to produce this enhanced cooling effect. As a result, no thimbles are present in the annular space to impede the flow of the cooling air through the annular space.

Figure 6:
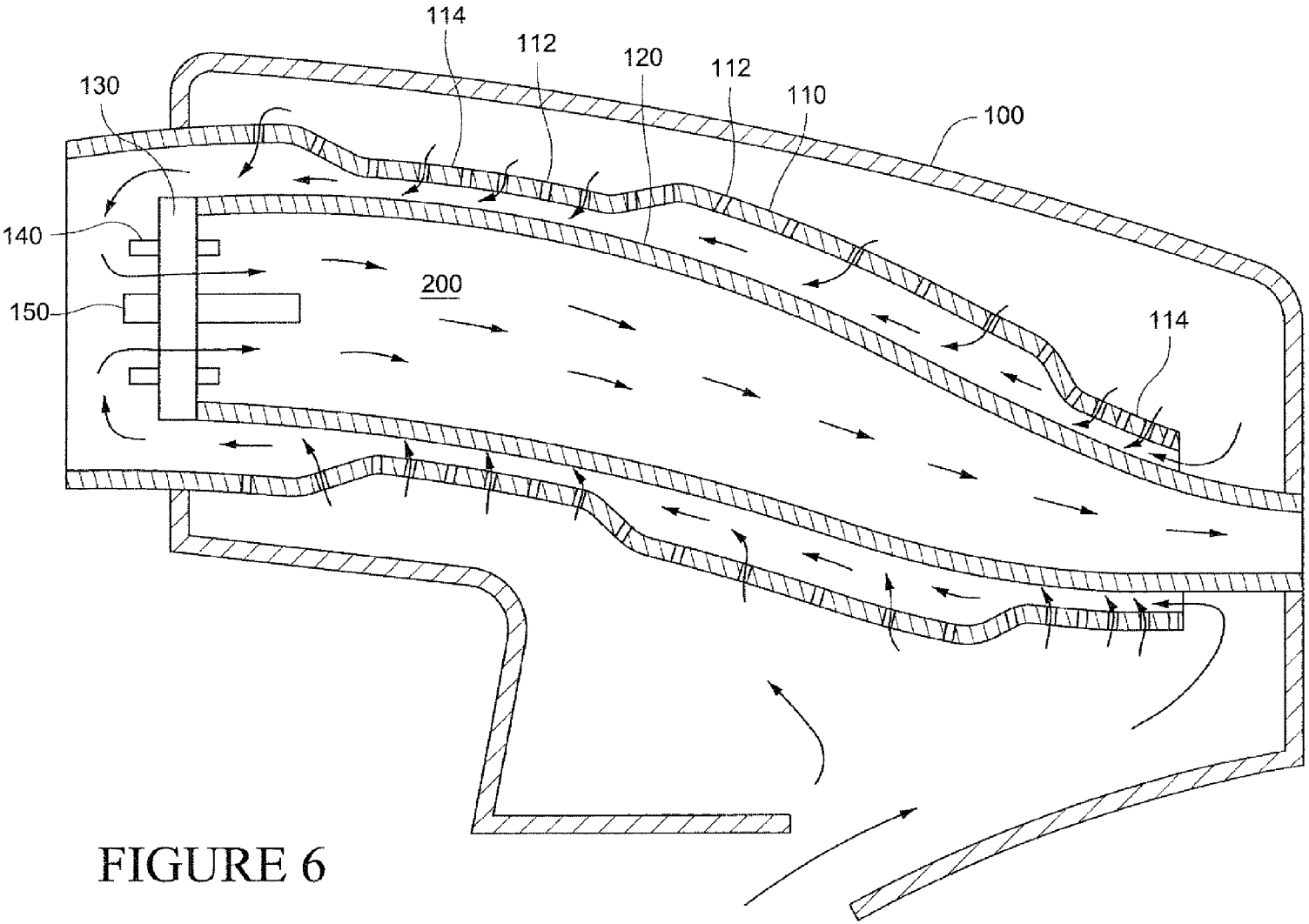
FIG. 6 illustrates a combustor assembly which includes a flow sleeve having two reduced diameter portions.

FIG. 6 illustrates a combustor assembly which includes a flow sleeve 110 having two reduced diameter portions. As shown in FIG. 6, a first reduced diameter portion 114 is located at the downstream end of the combustor liner 120. This reduced diameter portion 114 is located adjacent a portion of the combustor liner 120 which is reducing in diameter prior to delivering the combustion gases into the turbine section of the engine.

The flow sleeve 110 shown in FIG. 6 also includes a second reduced diameter portion 114 which is located at the upstream end of the combustor liner 120. This second reduced diameter portion 114 of the flow sleeve 110 is located adjacent the combustion zone 200 inside the combustor liner 120.

As explained above, the reduced diameter portions 114 of the flow sleeve 110 help to enhance the cooling effect of the cooling air passing through the cooling holes 112, to provide greater cooling to selected portions of the combustor liner 120. In addition, as illustrated in FIG. 6, the number of cooling holes per unit of area may be greater in the reduced diameter portions 114 of the flow sleeve 110, as compared to the greater diameter portions of the flow sleeve. Here again, providing an increased number of cooling holes per unit area further helps to enhance the cooling effect provided to the combustor liner adjacent the reduced diameter portions 114 of the flow sleeve 110.

Figure 7:
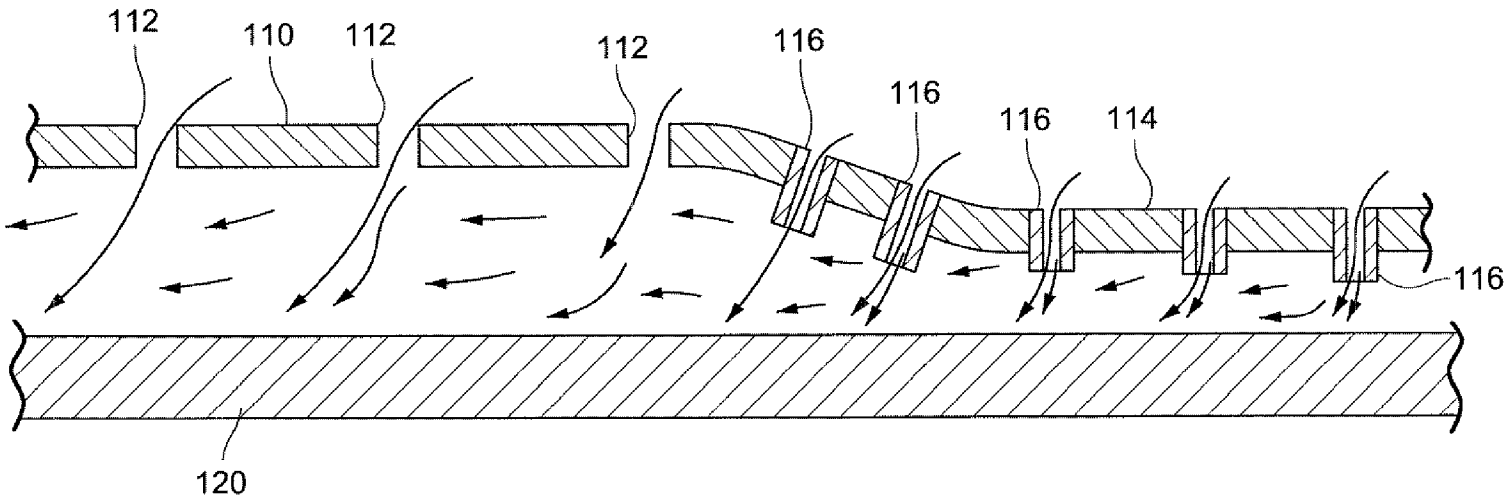
FIG. 7 is a cross sectional view showing a portion of a combustor assembly which includes a combustor liner and a flow sleeve which includes a reduced diameter portion, with cooling thimbles located in cooling holes of the reduced diameter portion.

FIG. 7 illustrates another embodiment of a combustor assembly including a combustor liner 120 and a flow sleeve 110. In the embodiment illustrated in FIG. 7, cooling thimbles 116 are provided in the cooling holes 112 of a reduced diameter portion 114 of a flow sleeve 110. By both reducing the diameter of the flow sleeve, to reduce a height of the annular space, and by also providing cooling thimbles 116 in the cooling holes 112 at the reduced diameter portion 114, one can maximize the cooling effect of the cooling air passing through the cooling thimbles 116 and impinging against the outer surface of the combustor liner 120.

Figure 8:
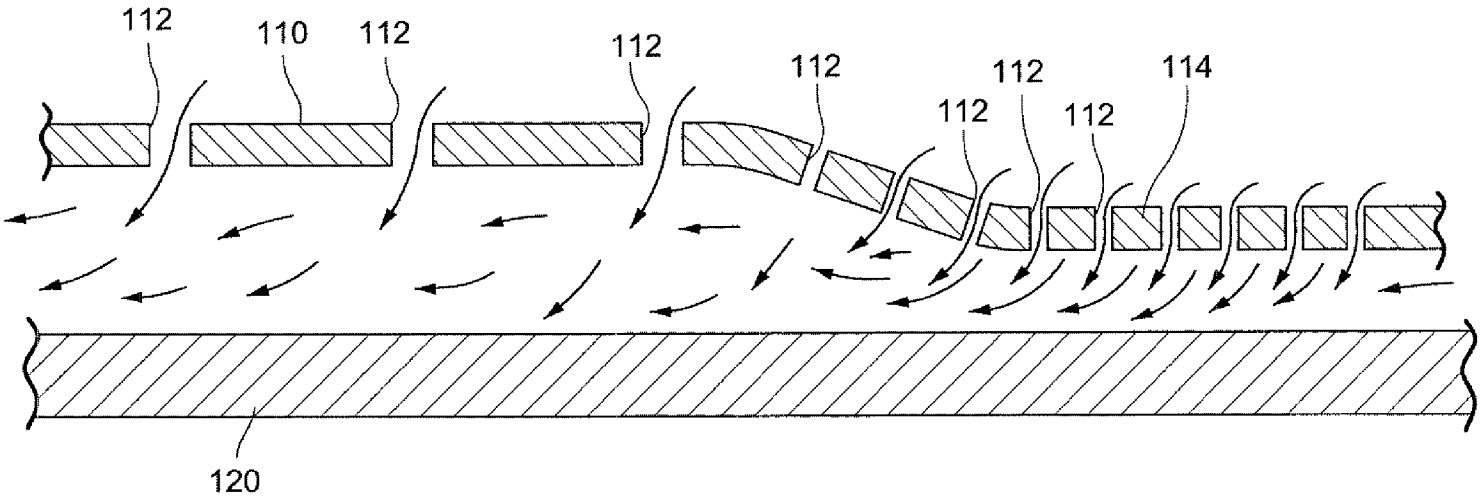
FIG. 8 is a cross sectional view showing a portion of a combustor assembly that includes a combustor liner and a flow sleeve having a reduced diameter portion.

FIG. 8 illustrates another embodiment of a combustor assembly. In the embodiment illustrated in FIG. 8, a greater number of cooling holes 112 per unit of area are formed on the reduced diameter portion 114 of the flow sleeve 110. In addition, a diameter of each individual cooling hole 112 is smaller in the reduced diameter portion 114 of the flow sleeve 110 as compared to the greater diameter portions of the flow sleeve 110.

Figure 9:
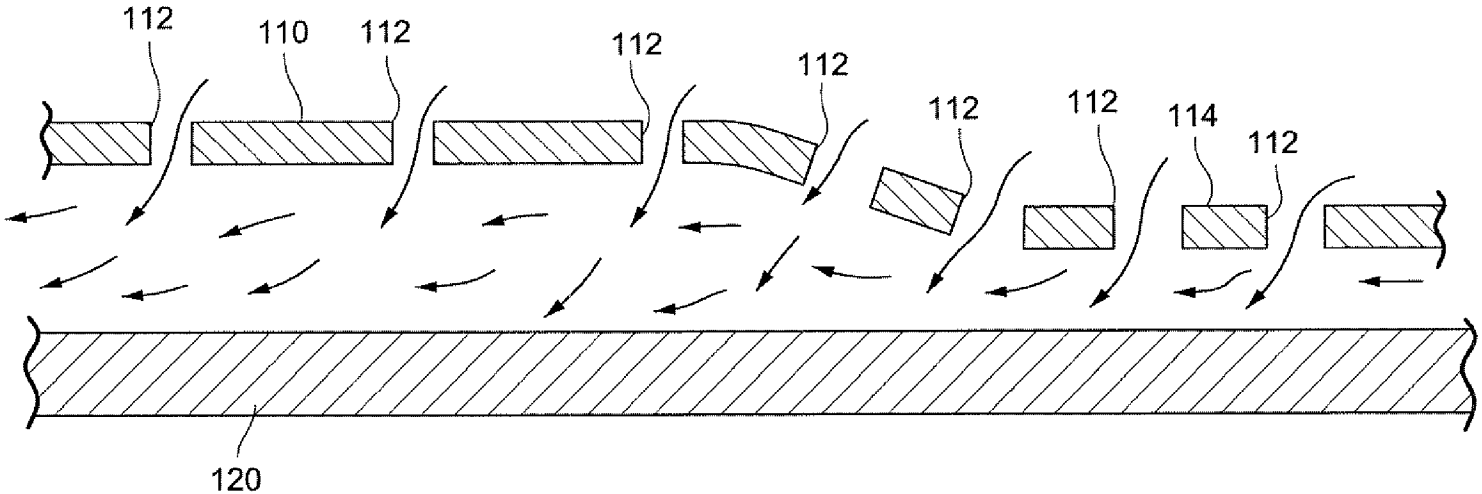
FIG. 9 is a cross sectional view showing a portion of a combustor assembly which includes a combustor liner and a flow sleeve having a reduced diameter portion.

FIG. 9 illustrates yet another embodiment. In the embodiment illustrated in FIG. 9, the diameter of the cooling holes 112 in the reduced diameter portion 114 of the flow sleeve 110 is greater than a diameter of the cooling holes 112 in other portions of the flow sleeve 110.

Varying the diameter of the cooling holes as illustrated in FIGS. 8 and 9 can vary the cooling effect provided by the cooling holes. In some instances, it may be advantageous to decrease the diameter of the cooling holes in the reduced diameter portion of the flow sleeve. In other instances, it may be advantageous to increase the diameter of the cooling holes in the reduced diameter portion of the flow sleeve.

Figure 10:
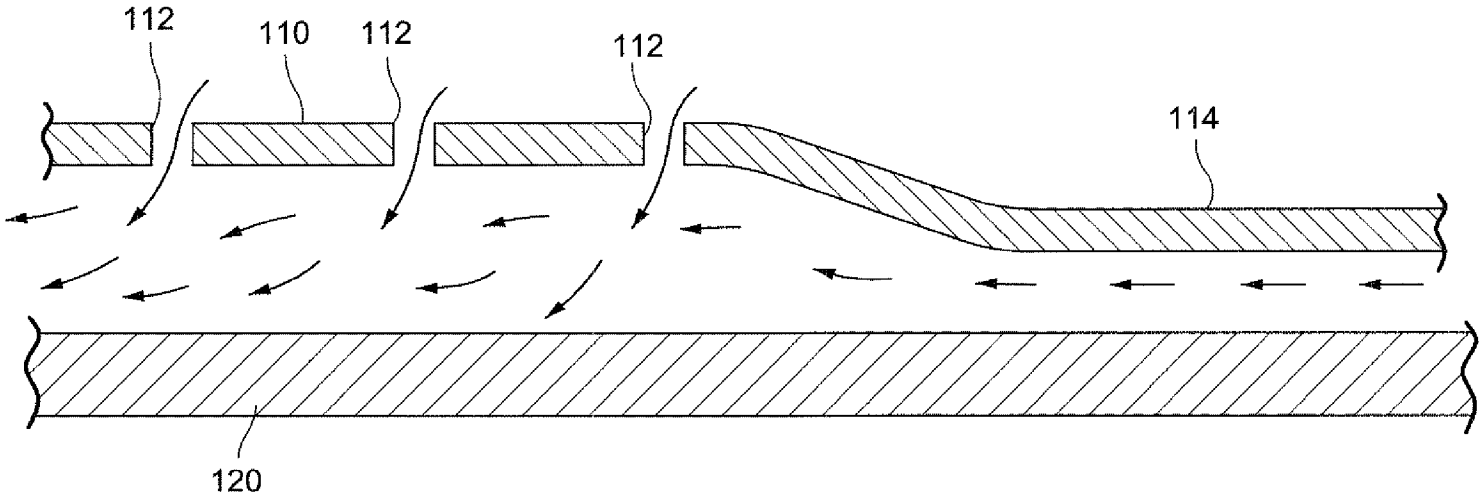
FIG. 10 is a cross sectional view showing a portion of a combustor assembly which includes a combustor liner and a flow sleeve having a reduced diameter portion.

FIG. 10 illustrates yet another embodiment. In this embodiment, no cooling holes are formed in the reduced diameter portion 114 of the flow sleeve 110. The reduced diameter portion 114 causes the speed of the air flowing in the annular space between the flow sleeve 110 and the combustor liner 120 to increase in the reduced diameter portion 114. The increase in the speed of the air flow provides enhanced cooling at the reduced diameter portion 114.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A combustor for a turbine engine, comprising:

a combustor liner;

an end cap mounted at an upstream end of the combustor liner; and a flow sleeve that surrounds an exterior of the combustor liner, wherein compressed air flows through an annular space between an outer surface of the combustor liner and an inner surface of the flow sleeve, wherein cooling holes penetrate the flow sleeve, the cooling holes allowing compressed air to flow from an exterior of the flow sleeve into the annular space, and wherein the flow sleeve includes at least one reduced diameter portion, a height of the annular space being smaller along the at least one reduced diameter portion of the flow sleeve than along other portions of the flow sleeve, wherein a diameter of the cooling holes along the at least one reduced diameter portion of the flow sleeve is greater than a diameter of the cooling holes along the other portions of the flow sleeve.

2. The combustor of claim 1, wherein a greater number of cooling holes per unit area are formed along the at least one reduced diameter portion of the flow sleeve than along other portions of the flow sleeve.

3. The combustor of claim 2, wherein cooling thimbles are mounted in the cooling holes located along the at least one reduced diameter portion of the flow sleeve.

4. The combustor of claim 3, wherein each of the cooling thimbles includes a cylindrical barrel that extends from the inner surface of the flow sleeve towards the outer surface of the combustor liner.

5. The combustor of claim 1, wherein the at least one reduced diameter portion comprises:

a first reduced diameter portion;

a second reduced diameter portion; and an intermediate portion that is located between the first and second reduced diameter portions, wherein a height of the annular space along the intermediate portion is greater than a height of the annular space along the first and second reduced diameter portions.

6. The combustor of claim 5, wherein a height of the annular space is smaller along the first reduced diameter portion of the flow sleeve than along the second reduced diameter portion of the flow sleeve.

7. The combustor of claim 5, wherein the first reduced diameter portion of the flow sleeve is located at an upstream end of the combustor adjacent a combustion zone inside the combustor liner.

8. The combustor of claim 7, wherein the second reduced diameter portion of the flow sleeve is located at a downstream end of the combustor adjacent a transition duct.

9. The combustor of claim 5, wherein a greater number of cooling holes per unit area are formed along the first reduced diameter portion of the flow sleeve than along the second reduced diameter portion of the flow sleeve.

10. A combustor for a turbine engine, comprising:

a combustor liner;

an end cap mounted at an upstream end of the combustor liner; and a flow sleeve that surrounds an exterior of the combustor liner, wherein compressed air flows through an annular space between an outer surface of the combustor liner and an inner surface of the flow sleeve in a direction that is opposite to a flow direction of combustion gases inside the combustor liner, wherein cooling holes penetrate the flow sleeve, the cooling holes allowing compressed air to flow from an exterior of the flow sleeve into the annular space, wherein the flow sleeve includes a reduced diameter portion where a height of the annular space between the inner surface of the flow sleeve and the outer surface of the combustor is smaller than along other portions of the combustor liner, the reduced diameter portion surrounding a combustion zone for a secondary fuel nozzle of the combustor, and wherein a diameter of the cooling holes along the reduced diameter portion of the flow sleeve is greater than a diameter of the cooling holes along the other portions of the flow sleeve.

11. The combustor of claim 10, wherein there is a greater number of cooling holes per unit area along portions of the flow sleeve that are adjacent smaller height portions of the annular space as compared to those portions of the flow sleeve that are adjacent greater height portions of the annular space.

12. The combustor of claim 10, further comprising cooling thimbles that are mounted in the cooling holes located along the portion of the flow sleeve that surrounds the combustion zone for a secondary fuel nozzle of the combustor.

13. The combustor of claim 10, wherein the reduced diameter portion of the flow sleeve comprises a first reduced diameter portion, and wherein the flow sleeve also includes a second reduced diameter portion and an intermediate portion that is located between the first and second reduced diameter portions, wherein a height of the annular space along the intermediate portion is greater than a height of the annular space along the first and second reduced diameter portions.

14. The combustor of claim 13, wherein the height of the annular space along the first reduced diameter portion of the flow sleeve is smaller than the height of the annular space along the second reduced diameter portion of the flow sleeve.

* * * * *